US012768097B2

(12) United States Patent
Kim

(10) Patent No.: US 12,768,097 B2
(45) Date of Patent: Oct. 20, 2026

(54) SEAT IRONING SYSTEM AND METHOD OF OPERATING SAME

(71) Applicant: HANUL SYSTEM CO., LTD., Daegu (KR)

(72) Inventor: Ho Young Kim, Daegu (KR)

(73) Assignee: HANUL SYSTEM CO., LTD., Daegu (KR)

( * ) Notice: Subject to any disclaimer, the term of this patent is extended or adjusted under 35 U.S.C. 154(b) by 198 days.

(21) Appl. No.: 18/731,963

(22) Filed: Jun. 3, 2024

(65) Prior Publication Data

US 2025/0084584 A1 Mar. 13, 2025

(30) Foreign Application Priority Data

Sep. 8, 2023 (KR) ..... 10-2023-0119669
Oct. 11, 2023 (KR) ..... 10-2023-0135474
Mar. 11, 2024 (KR) ..... 10-2024-0033690

(51) Int. Cl.
*D06F 73/02* (2006.01)
*D06F 67/02* (2006.01)
*D06F 71/34* (2006.01)

(52) U.S. Cl.
CPC ..... *D06F 73/02* (2013.01); *D06F 67/02* (2013.01); *D06F 71/34* (2013.01)

(58) Field of Classification Search
CPC ..... D06F 73/02; D06F 67/02; D06F 71/34
See application file for complete search history.

(56) References Cited

U.S. PATENT DOCUMENTS 3,765,580 A * 10/1973 Wilsker ..... D06F 73/02 68/5 D
6,405,461 B1 6/2002 Groel et al.
7,870,685 B2 * 1/2011 Wurm ..... B60N 2/5891 38/14
2004/0200092 A1 * 10/2004 Heinz ..... B60N 2/5891 34/376

(Continued)

FOREIGN PATENT DOCUMENTS

CN 208250748 U 12/2018
CN 108642832 B 8/2023

(Continued)

OTHER PUBLICATIONS

Communication dated Aug. 6, 2024 in Korean Application No. 10-2023-0119669.

(Continued)

*Primary Examiner* — Nathan E Durham
(74) *Attorney, Agent, or Firm* — Sughrue Mion, PLLC

(57) ABSTRACT

An embodiment of the present invention provides a seat ironing system including a first vision unit that photographs a seat, a seat preheating unit that preheats the seat passing through the first vision unit to a predetermined temperature, an ironing robot unit provided with a steam ironing unit that removes wrinkles from the seat passing through the seat preheating unit, and a seat heat treatment unit that heat-treats the seat from which the wrinkles are removed through the ironing robot unit, wherein the ironing robot unit removes the wrinkles from the seat based on seat image information provided from the first vision unit.

13 Claims, 12 Drawing Sheets

(56) References Cited

U.S. PATENT DOCUMENTS

| | | | | |
|---|---|---|---|---|
| 2008/0034807 | A1* | 2/2008 | Littmann | D06F 73/02 68/5 C |
| 2023/0128707 | A1 | 4/2023 | Kim | |
| 2024/0052553 | A1 | 2/2024 | Jang et al. | |
| 2024/0221148 | A1 | 7/2024 | Kim | |

FOREIGN PATENT DOCUMENTS

| | | | | |
|---|---|---|---|---|
| FR | 2533239 | A1 * | 3/1984 | D06F 73/02 |
| JP | H08-252398 | A | 10/1996 | |
| JP | 2010-215206 | A | 9/2010 | |
| KR | 20-0174923 | Y1 | 3/2000 | |
| KR | 20-0417397 | Y1 | 5/2006 | |
| KR | 20-0417847 | Y1 | 6/2006 | |
| KR | 10-2007-0090300 | A | 9/2007 | |
| KR | 10-2014-0008191 | A | 1/2014 | |
| KR | 10-1438540 | B1 | 9/2014 | |
| KR | 10-1449926 | B1 | 10/2014 | |
| KR | 10-1542719 | B1 | 8/2015 | |
| KR | 10-2079661 | B1 | 2/2020 | |
| KR | 10-2020-0081084 | A | 7/2020 | |
| KR | 10-2255019 | B1 | 5/2021 | |
| KR | 10-2327594 | B1 | 11/2021 | |
| KR | 10-2354314 | B1 | 1/2022 | |
| KR | 10-2367078 | B1 | 2/2022 | |
| KR | 10-2367079 | B1 | 2/2022 | |
| KR | 10-2394208 | B1 | 5/2022 | |
| KR | 10-2408693 | B1 | 6/2022 | |
| KR | 10-2022-0096561 | A | 7/2022 | |
| WO | 2022/260431 | A1 | 12/2022 | |

OTHER PUBLICATIONS

Communication dated May 13, 2024 in Korean Application No. 10-2024-0033690.

International Search Report dated Sep. 4, 2024 in Application No. PCT/KR2024/006162.

Extended European Search Report dated Dec. 3, 2024 in Application No. 24179729.9.

* cited by examiner (a)

(b)

SEAT IRONING SYSTEM AND METHOD OF OPERATING SAME

CROSS-REFERENCES TO RELATED APPLICATIONS

The application claims priority to Korean Patent Application No. 10-2023-0119669 filed Sep. 8, 2023, Korean Patent Application No. 10-2023-0135474 filed Oct. 11, 2023, Korean Patent Application No. 10-2024-0033690 filed Mar. 11, 2024, the entire disclosures of which are incorporated herein by reference.

TECHNICAL FIELD

The present invention relates to a seat ironing system and a method of operating the same, and more particularly, to a seat ironing system that effectively removes wrinkles from seats and a method of operating the same.

BACKGROUND ART

Generally, vehicle seats are finished by installing headrests and various adjustment devices on the vehicle seats and then covering outer peripheries of the seats with fabric or leather covers. However, in a process of covering an outer periphery of a seat with a fabric or leather cover, a large amount of wrinkles may be generated on a seat cover. In this way, the wrinkles generated on the seat cover should be removed through a separate wrinkle removing operation.

In the related art, to remove the wrinkles generated on the seat cover, an operator removes the wrinkles from the seat cover through ironing one by one while gripping a steam iron manually.

However, in the wrinkle removing operation according to the related art, the wrinkles generated on the seat cover cannot be completely removed, and work efficiency is also low. Further, in a process of removing wrinkles from a seat cover, an incidence of damage to the seat cover is high, and accidents of the operator also frequently occur.

Thus, various types of R&D on a seat ironing system that automatically removes the wrinkles generated on the seat cover using a robot rather than manual work have been conducted.

DISCLOSURE

Technical Problem

The present invention is directed to providing a seat ironing system that effectively removes wrinkles from a seat and a method of operating the same.

Technical Solution

One aspect of the present invention provides a seat ironing system including a first vision unit that photographs a seat, a seat preheating unit that preheats the seat passing through the first vision unit to a predetermined temperature, an ironing robot unit provided with a steam ironing unit that removes wrinkles from the seat passing through the seat preheating unit, and a seat heat treatment unit that heat-treats the seat from which the wrinkles are removed through the ironing robot unit, wherein the ironing robot unit removes the wrinkles from the seat based on seat image information provided from the first vision unit.

The seat preheating unit may include a heating booth in which a preheating space in which the seat is accommodated is formed, and a heating unit that preheats the seat moved to the preheating space, and the heating unit may be optionally operated according to a material of the seat moved to the preheating space.

The heating unit may include a first heater that is installed in the heating booth and preheats a cushion seat provided in the seat, and a second heater that is installed in the heating booth and preheats a back seat provided in the seat, and the first heater and the second heater may be infrared heaters.

The ironing robot unit may have a first seat wrinkle removing robot and a second seat wrinkle removing robot that perform a wrinkle removing operation on the seat according to a material of the seat, and the first seat wrinkle removing robot may perform a wrinkle removing operation on a leather seat, and the second seat wrinkle removing robot may perform a wrinkle removing operation on a fabric seat.

The first seat wrinkle removing robot may be provided in plurality, and the plurality of first seat wrinkle removing robot may remove the wrinkles from the seat through cooperative work.

The first seat wrinkle removing robot may be provided with a first steam ironing unit that removes the wrinkles from the seat, the first steam ironing unit may include a fixing mount coupled to a mounting plate of the first seat wrinkle removing robot, a seat pressing steam roller that has a fluid accommodating space formed therein and irons the seat while being rotated in close contact with the seat by operating the first seat wrinkle removing robot, a hot air supply unit that is fixedly supported on the fixing mount and supplies hot air into the seat pressing steam roller, and a pair of steam supply units that supply steam generated from a steam tank into the seat pressing steam roller, and a plurality of spray holes may be formed in the seat pressing steam roller at predetermined intervals.

The steam supply unit may supply the steam to fluid supply guides that support both ends of the seat pressing steam roller and spaced a predetermined interval from each other, the hot air supply unit may be coupled to a hot air distributing unit communicating with the fluid supply guides, and a hot air discharged from the hot air supply unit may be distributed and supplied to the spaced fluid supply guides through the hot air distributing unit, and the steam and the hot air discharged from the steam supply unit and the hot air supply unit to the fluid supply guides may be supplied to the fluid accommodating space.

The seat ironing system may further include a movement adjusting unit supported on the fixing mount, wherein the movement adjusting unit may include a pair of support frames coupled to one side and the other side of the fixing mount to face each other, a shaft support coupled to an interior of the support frame, a shaft coupled to an end portion of the fluid supply guide and inserted to pass through the shaft support, a stopper coupled to an end portion of the shaft, and an elastic spring which is inserted to pass through the shaft and of which one end is supported on the shaft support and the other end is supported on the fluid supply guide, and the seat pressing steam roller may enable one or more of adjusting a pressing force and tilting by the movement adjusting unit in a process in which the seat pressing steam roller is in close contact with and pressed against the seat.

The seat pressing steam roller may include a rotating roller unit having a roller pipe, which has a cylindrical shape and the fluid accommodating space therein, and a roller cover part that closes both open sides of the roller pipe, a roller support pin that is inserted to pass through a pin insertion hole formed in the fluid supply guide and supports the rotating roller unit on the fluid supply guide, and a bearing of which an outer ring is supported on a bearing support provided in the roller pipe and an inner ring is supported on the roller support pin, and a first communication hole communicating with a fluid movement passage formed inside the fluid supply guide and a second communication hole communicating with the first communication hole may be formed in the roller support pin, and the rotating roller unit may be rotated while supported on the roller support pin.

The roller support pin may be provided as a pair of roller support pins provided with an expansion pipe part having a third communication hole communicating with the second communication hole, a flange part provided in the expansion pipe part may connect the pair of roller support pins facing each other, a plurality of discharge holes that discharge the steam and the hot air to the fluid accommodating space may be formed in the expansion pipe part, and the third communication hole may be formed to have a larger hole size than the second communication hole.

An outer circumference of the roller pipe may have a rounded shape, and the roller pipe may be made of an aluminum material.

The spray holes formed in the roller pipe may be formed at predetermined intervals in a longitudinal direction of the roller pipe and may be arranged at intervals of 15° to 30° along a circumference of the roller pipe with respect to an imaginary central axis.

The first vision unit may be provided with a first camera unit that photographs the seat from which the wrinkles are removed, and the first camera unit may include a first photographing unit that photographs a portion of a cushion seat of the seat and a second photographing unit that photographs a portion of a back seat of the seat, and the second vision unit may include a second camera unit that photographs remaining wrinkles in the seat and a processor that receives remaining wrinkle image information of the seat photographed by the second camera unit, and the second camera unit may include a third photographing unit photographs the portion of the cushion seat of the seat and a fourth photographing unit that photographs the portion of the back seat of the seat.

The processor may calculate the number, locations, and sizes of the remaining wrinkles in the seat based on the remaining wrinkle image information, and the number, the locations, and the sizes of the remaining wrinkles in the seat, which are calculated by the processor, may be displayed on a monitor unit.

Another aspect of the present invention provides a method of operating a seat ironing system, including photographing, by a first vision unit, a state of a wrinkle of a seat, -preheating, by a seat preheating unit, the seat passing through the first vision unit, removing, by an ironing robot unit, the wrinkle of the seat passing through the seat preheating unit, heat treating, by a seat heat treatment unit, the seat passing through the ironing robot unit, and photographing, by a second vision unit, remaining wrinkles of the seat passing through the seat heat treatment unit, wherein a processor provided in the second vision unit determines whether the remaining wrinkles are present in the seat by calculating the number, locations, and sizes of the remaining wrinkles in the seat based on remaining wrinkle image information provided from a second camera unit provided in the second vision unit.

When the processor determines that the remaining wrinkles are present in the seat, the remaining wrinkles are removed from the seat through a remaining wrinkle removing robot or manual work.

Advantageous Effects

The effects of the seat ironing system and a method of operating the same according to the present invention as described above will be described below.

According to the present invention, the seat ironing system is provided with a seat preheating unit that preheats a seat to a sufficient temperature. The seat preheating unit preheats the seat before the seat is ironed, and thus wrinkles can be effectively removed from the seat in a seat ironing process.

According to the present invention, a plurality of first seat wrinkle removing robots effectively remove the wrinkles generated on a leather seat through cooperative work. A first steam ironing unit mounted on the first seat wrinkle removing robot removes the wrinkles from the seat while in close contact with and pressed against the seat. The first steam ironing unit removes the wrinkles from the seat through rotation of a seat pressing steam roller. The first steam ironing unit can effectively remove the wrinkles from the seat as compared to a steam ironing unit having a flat ironing surface according to the related art. That is, the first steam ironing unit according to the present invention can effectively remove the wrinkles from the seat even on curved seat surfaces.

The first steam ironing unit is provided with a movement adjusting unit that adjusts a pressing force and tilting of the seat pressing steam roller. The movement adjusting unit adjusts the seat pressing steam roller such that the seat pressing steam roller presses the seat with a predetermined pressing force. Accordingly, the seat pressing steam roller can perform the same wrinkle removing operation on all seat surfaces. Further, the movement adjusting unit not only adjusts the pressing force but also is tilted, and thus an effective seat ironing operation can be performed even on seats having various shapes.

The effects of the present invention are not limited to the above effects and should be understood to include all effects that may be deduced from the detailed description of the present invention or the configuration of the present invention described in the appended claims.

MODES OF THE INVENTION

Figure 1:
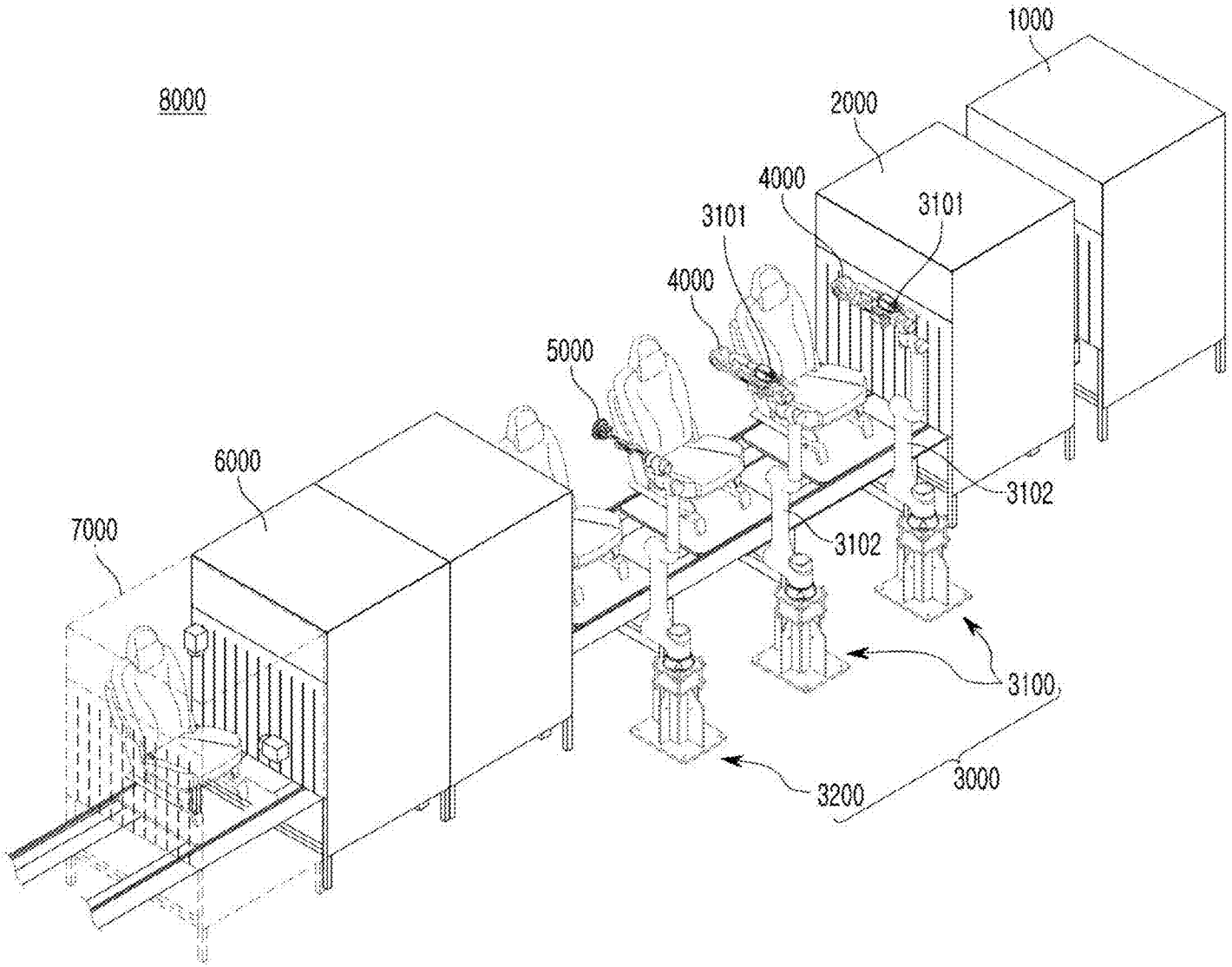
FIG. 1 is a perspective view illustrating a seat ironing system according to an embodiment of the present invention.

Hereinafter, the present invention will be described with reference to the accompanying drawings. However, the present invention may be implemented in various different forms and thus is not limited to embodiments described herein. Further, in the drawings, parts irrelevant to the description are omitted in order to clearly describe the present invention, and throughout the specification, similar numerals reference numerals are assigned to similar parts.

Throughout the specification, when a first part is connected to a second part, this includes not only a case in which the first part is "directly connected" to the second part but also a case in which the first part is "indirectly connected" to the second part with a third part interposed therebetween. Further, when a part "includes" a component, this means that another component is not excluded but may be further included unless otherwise stated.

In the present invention, an upper side and a lower side mean a state of being located above or below a target member and do not necessarily mean a state of located above or below the target member with respect to the direction of gravity.

Hereinafter, embodiments of the present invention will be described in detail with reference to the accompanying drawings.

Figure 2:
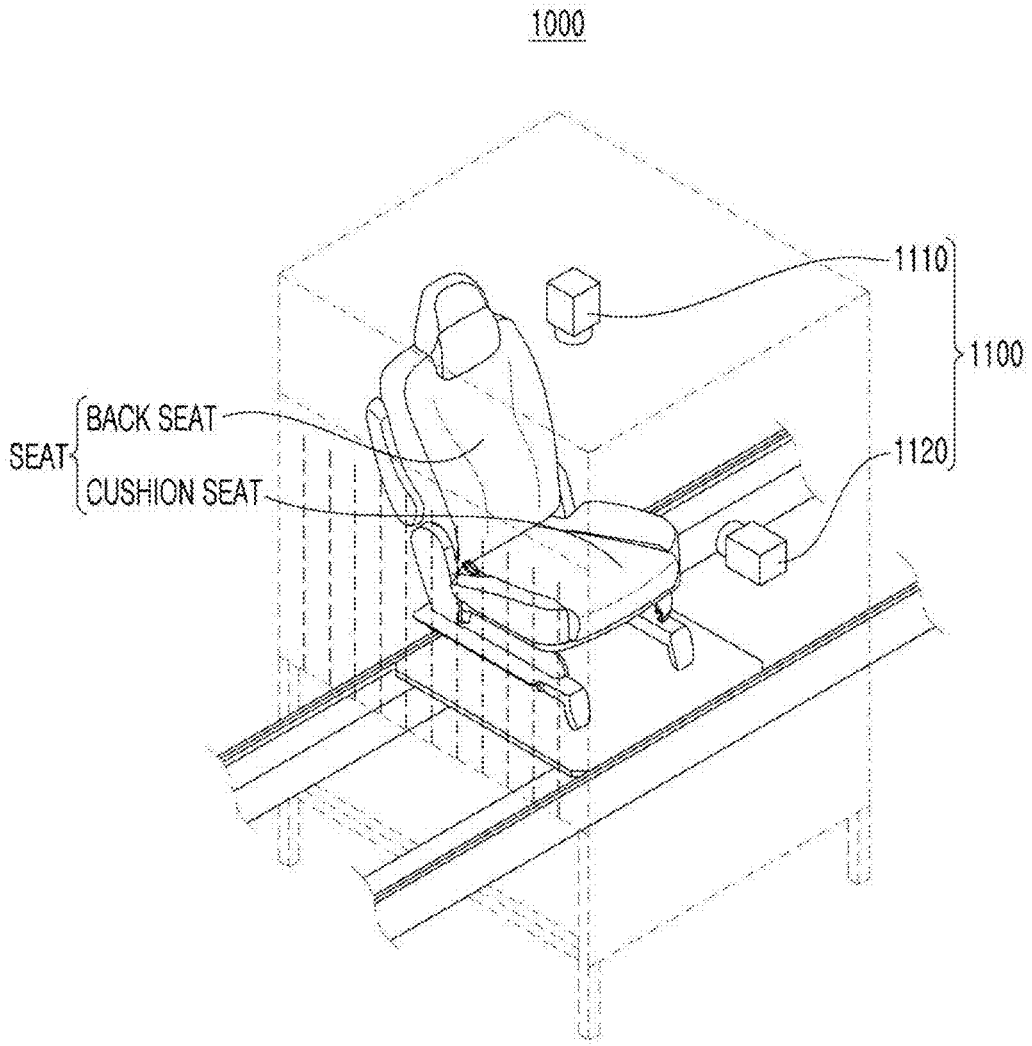
FIG. 2 is an exemplary view illustrating a first vision unit according to an embodiment of the present invention.
Figure 3:
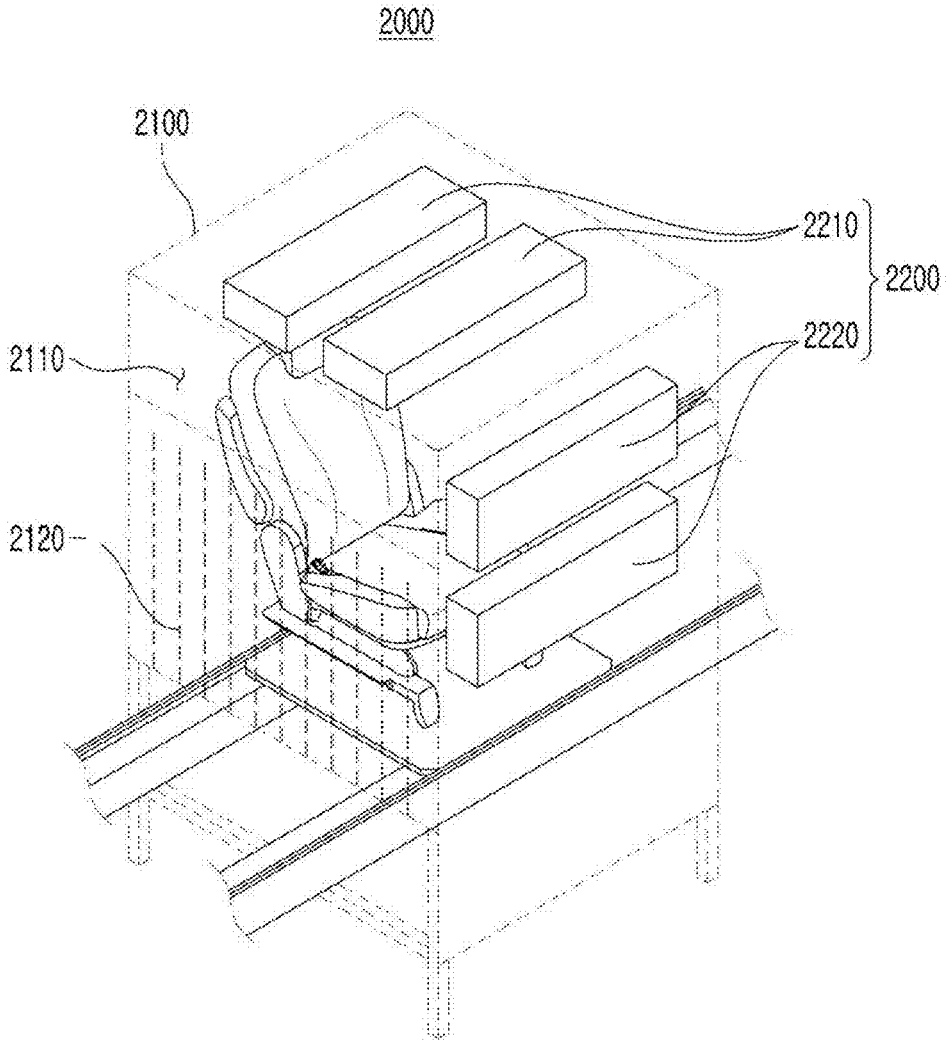
FIG. 3 is an exemplary view illustrating a seat preheating unit according to an embodiment of the present invention.
Figure 4:
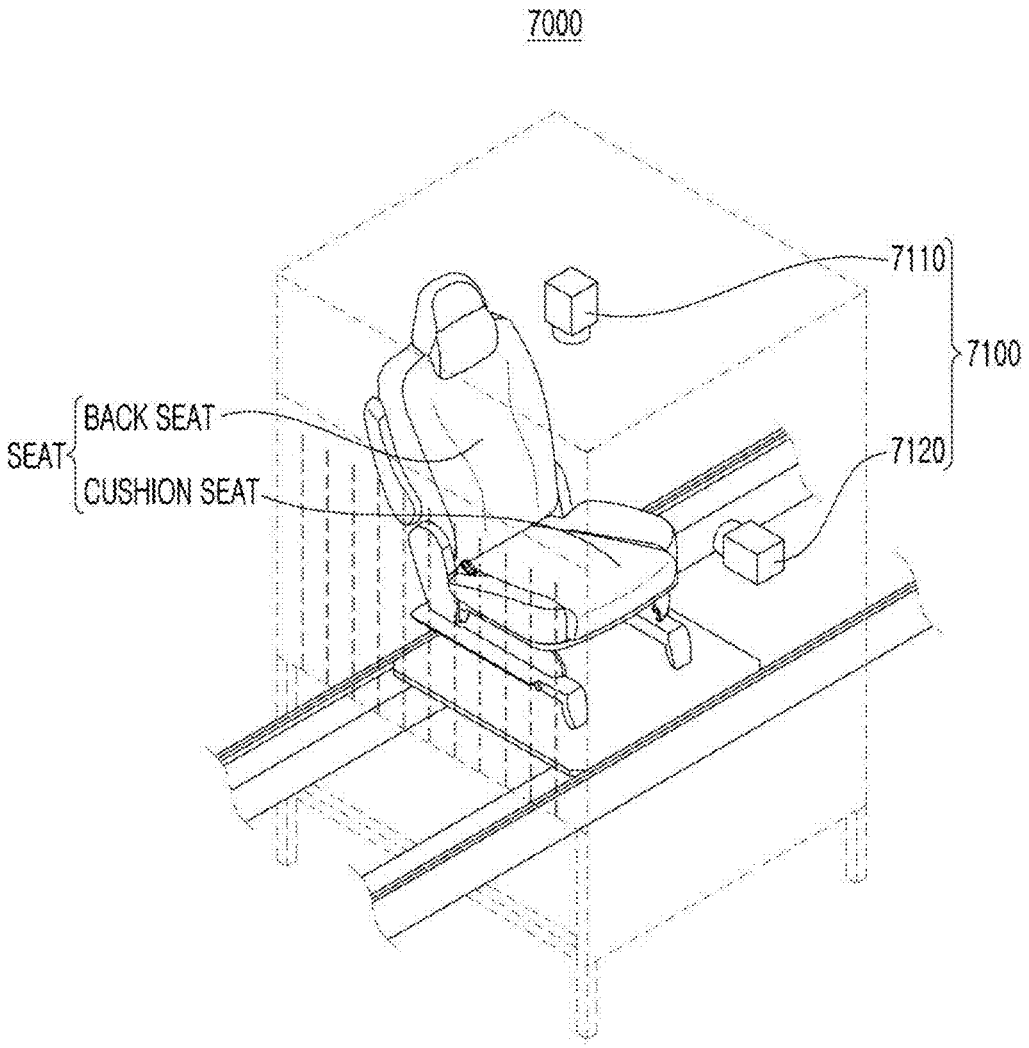
FIG. 4 is an exemplary view illustrating a second vision unit according to an embodiment of the present invention.
Figure 5:
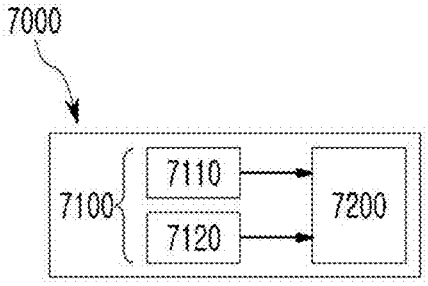
FIG. 5 is a diagram illustrating a configuration of the second vision unit according to the embodiment of the present invention.
Figure 6:
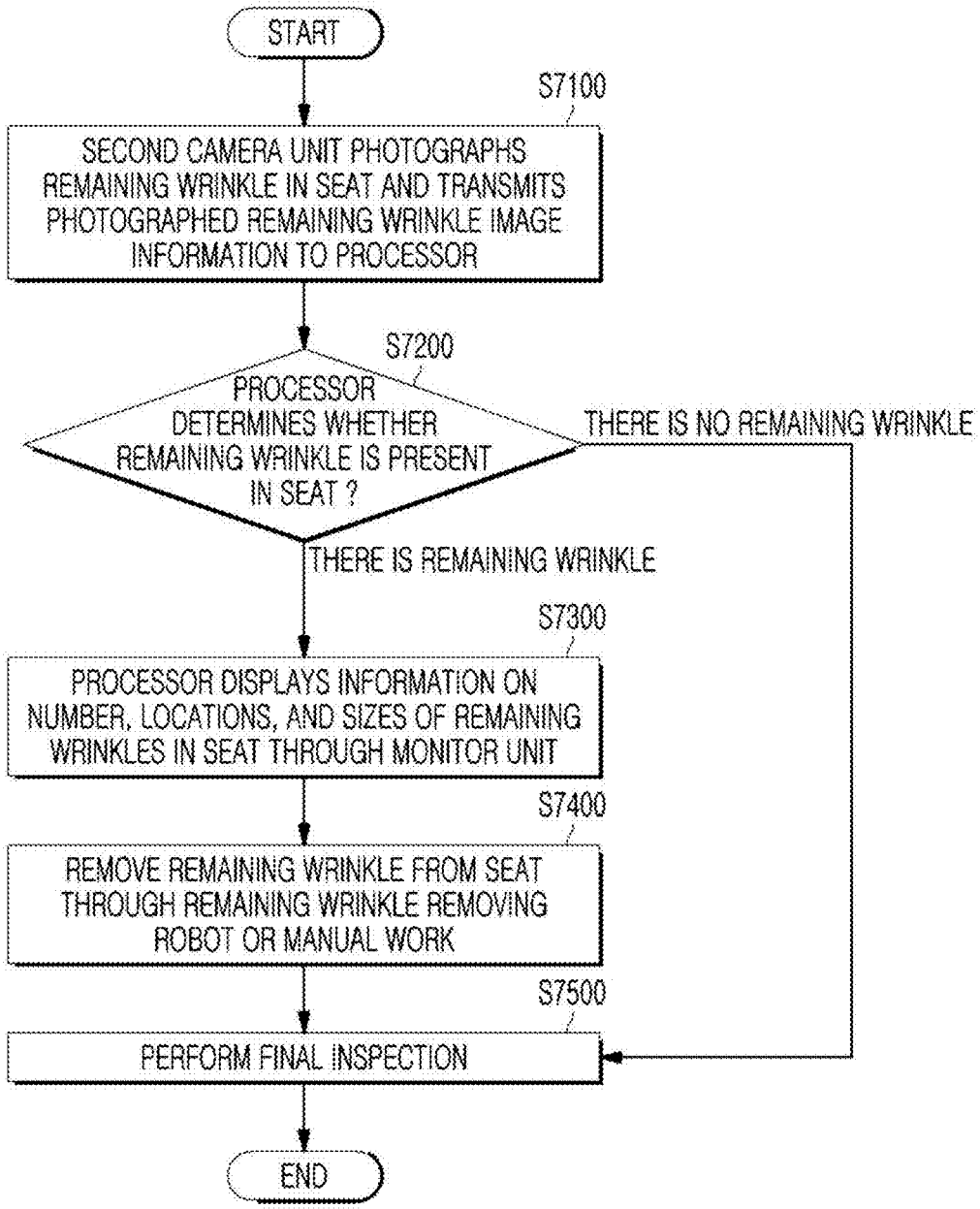
FIG. 6 is a flowchart of an operation of the second vision unit according to the embodiment of the present invention.

FIG. 1 is a perspective view illustrating a seat ironing system according to an embodiment of the present invention, FIG. 2 is an exemplary view illustrating a first vision unit according to an embodiment of the present invention, FIG. 3 is an exemplary view illustrating a seat preheating unit according to an embodiment of the present invention, FIG. 4 is an exemplary view illustrating a second vision unit according to an embodiment of the present invention, FIG. 5 is a diagram illustrating a configuration of the second vision unit according to the embodiment of the present invention, and FIG. 6 is a flowchart of an operation of the second vision unit according to the embodiment of the present invention.

As illustrated in FIGS. 1 to 6, a seat ironing system 8000 may include a first vision unit 1000, a seat preheating unit 2000, an ironing robot unit 3000, a first steam ironing unit 4000, a second steam ironing unit 5000, and a seat heat treatment unit 6000. The seat ironing system 8000 may further include a second vision unit 7000 disposed in a subsequent process of the seat heat treatment unit 6000.

The first vision unit 1000 is formed to identify a current state of a seat. The seat in the present invention may be, for example, a vehicle seat.

The first vision unit 1000 may be provided with a first camera unit 1100 to identify a current state of the seat on which a wrinkle removing operation is to be performed. In this way, seat image information photographed through the first camera unit 1100 may be provided to the seat preheating unit 2000 and the ironing robot unit 3000, which will be described below. Here, the seat image information photographed through the first camera unit 1100 may be various pieces of information such as a material of the seat and a location, a shape, and a size of wrinkles formed in the seat.

For example, the first camera unit 1100 may be a smart camera that can be shared online. Accordingly, the seat image information photographed through the first camera unit 1100 may be provided to the seat preheating unit 2000 and the ironing robot unit 3000 immediately after the photographing.

In the present invention, an example is described in which the first camera unit 1100 is provided with a first photographing unit 1110 that photographs a portion of a cushion seat of the seat and a second photographing unit 1120 that photographs a portion of a back seat of the seat. Here, the number of photographing units provided in the first camera unit 1100 is not limited to a specific number, and various numbers of the photographing units may be provided as long as the wrinkles in the seat can be more accurately identified.

The seat preheating unit 2000 may include a heating booth 2100 and a heating unit 2200.

The heating booth 2100 has a preheating space 2110 inside which the seat is accommodated.

The heating unit 2200 is installed in the heating booth 2100 to preheat the seat moved to the preheating space 2110.

The seat preheating unit 2000 is operated only when the material of the seat is leather, based on the seat image information provided from the first camera unit 1100. That is, the seat preheating unit 2000 operates the heating unit 2200 only when the material of the seat among seats moved to the preheating space 2110 through a preheating entry unit (not illustrated) is leather.

The seat preheating unit 2000 is optionally operated according to the material of the seat.

The seat preheating unit 2000 may preheat the seat before the seat is moved to the ironing robot unit 3000, and thus the wrinkle removing operation on the seat by operating the ironing robot unit 3000 may be performed more effectively.

The heating unit 2200 may include a first heater 2210 and a second heater 2220.

Here, the first heater 2210 is disposed to face the cushion seat of the seat to preheat the cushion seat. Here, the second heater 2220 is disposed to face the back seat of the seat to preheat the back seat.

For example, the first heater 2210 and the second heater 2220 may be infrared heaters capable of allowing heat to penetrate into the seat. Here, the first heater 2210 and the second heater 2220 are not necessarily the infrared heaters, and may be various heaters as long as the seat may be effectively preheated. In this way, the seat that is preheated in the seat preheating unit 2000 may be moved to the ironing robot unit 3000 through a preheating output unit 2120.

Meanwhile, the ironing robot unit 3000 irons the seat to remove the wrinkles formed in the seat.

The ironing robot unit 3000 may include a first seat wrinkle removing robot 3100 and a second seat wrinkle removing robot 3200.

Here, the first seat wrinkle removing robot 3100 and the second seat wrinkle removing robot 3200 are operated optionally according to the material (leather or fabric) of the seat. That is, the ironing robot unit 3000 optionally operates the first seat wrinkle removing robot 3100 or the second seat wrinkle removing robot 3200 based on the seat image information provided from the first vision unit 1000.

Here, the first steam ironing unit 4000 that may effectively iron leather seats is mounted on the first seat wrinkle removing robot 3100.

Further, the second steam ironing unit 5000 that may effectively iron fabric seats is mounted on the second seat wrinkle removing robot 3200.

In this way, the steam ironing units, which may effectively iron the seat according to the material of the corresponding seat, are mounted on the first seat wrinkle removing robot 3100 and the second seat wrinkle removing robot 3200, and thus the wrinkle removing operation on the seat can be effectively performed.

In the present invention, an example in which the number of first seat wrinkle removing robots 3100 is two will be described. The first seat wrinkle removing robot 3100 may be provided as a plurality of first seat wrinkle removing robots 3100, and the plurality of first seat wrinkle removing robots 3100 remove the wrinkles generated on the seat through cooperative work. As an example, the two first seat wrinkle removing robots 3100 may intensively remove wrinkles from the back seat, on which many wrinkles may be formed, through the cooperative work.

The first seat wrinkle removing robots 3100 effectively remove wrinkles from leather seats without burning the seat due to a high temperature.

Here, a detailed content of the first steam ironing unit 4000 that is mounted on the first seat wrinkle removing robot 3100 and substantially removes the wrinkles from the leather seat will be described below.

Further, the second steam ironing unit 5000 is mounted on the second seat wrinkle removing robot 3200. The second steam ironing unit 5000 effectively removes wrinkles generated on the fabric seat. The second steam ironing unit 5000 removes wrinkles generated on the cushion seat and the back seat, which are made of fabric, through an operation of the second seat wrinkle removing robot 3200.

Meanwhile, the seat heat treatment unit 6000 heat-treats the seat from which the wrinkles are removed by the ironing robot unit 3000. The seat heat treatment unit 6000 removes the wrinkles from the seat, which may not be completely removed by the ironing robot unit 3000 and may remain fine, through a heat treatment process.

Meanwhile, the second vision unit 7000 may include a second camera unit 7100 and a processor 7200. Here, the second camera unit 7100 includes a third photographing unit 7110 and a fourth photographing unit 7120 that photograph remaining wrinkles in the seat.

The second vision unit 7000 identifies remaining wrinkles in the seat that passes through the seat heat treatment unit 6000.

Here, the third photographing unit 7110 provided in the second vision unit 7000 photographs the portion of the cushion seat of the seat, and the fourth photographing unit 7120 provided in the second vision unit 7000 photographs the portion of the back seat of the seat. The third photographing unit 7110 and the fourth photographing unit 7120 photograph the remaining wrinkles in the seat. Here, the number of photographing units provided in the second camera unit 7100 is not limited to a specific number, and various numbers of the photographing units may be provided as long as the remaining wrinkles in the seat can be more accurately identified.

In this way, remaining wrinkle image information of the seat photographed by the third photographing unit 7110 and the fourth photographing unit 7120 may be provided to the processor 7200. Further, the processor 7200 calculates the number, locations, and sizes of the remaining wrinkles in the seat based on the remaining wrinkle image information provided from the third photographing unit 7110 and the fourth photographing unit 7120.

In this way, various pieces of information such as the number, the locations, and the sizes of the remaining wrinkles in the seat, which are calculated by the processor 7200, may be displayed through a monitor unit (not illustrated) provided in a field. Here, the monitor unit does not have to be installed in a specific location, and for example, may be disposed anywhere in a work site in which the remaining wrinkles are substantially removed. Accordingly, an operator may receive various pieces of information such as the number, the locations, and the sizes of the remaining wrinkles in the seat through the monitor unit.

In a schematic description of a process of operating the second vision unit 7000 with reference to FIG. 6, first, the second camera unit 7100, which is provided with the third photographing unit 7110 and the fourth photographing unit 7120, photographs the remaining wrinkles in the seat. Here, the second camera unit 7100 transmits the photographed remaining wrinkle image information to the processor 7200 (S7100).

Next, the processor 7200 determines whether the remaining wrinkles are present in the seat (S7200).

In this way, when it is determined through the processor 7200 that the remaining wrinkles are not present in the seat, the corresponding seat is finally inspected (S7500).

In contrast, when it is determined through the processor 7200 that the remaining wrinkles are present in the seat, the processor 7200 displays information on the number, the locations, and the sizes of the remaining wrinkles in the seat through the monitor unit (S7300).

Then, the remaining wrinkles are removed from the seat through a remaining wrinkle removing robot (not illustrated) or manual work. In this case, the operation of removing the remaining wrinkles in the seat is performed based on the information (the number, the locations, and the sizes of the remaining wrinkles in the seat) calculated by the processor 7200. Here, in the case of the manual work, the operator may remove the remaining wrinkles from the seat through direct ironing (S7400).

In this way, the seat from which the remaining wrinkles are removed is finally inspected (S7500).

In a schematic description of the entire process of operating the seat ironing system 8000 described above, first, the first vision unit 1000 photographs states of the wrinkles in the seat.

Next, the seat preheating unit 2000 preheats the seat passing through the first vision unit 1000. In this case, the seat preheating unit 2000 preheats the seat only when the material of the seat is leather.

Next, the ironing robot unit 3000 removes the wrinkles from the seat passing through the seat preheating unit 2000.

Next, the seat heat treatment unit 6000 heat-treats the seat passing through the ironing robot unit 3000.

Next, the second vision unit 7000 photographs the remaining wrinkles in the seat passing through the seat heat treatment unit 6000. The second vision unit 7000 determines whether the remaining wrinkles are present in the seat. Here, when the remaining wrinkles are present in the seat, the remaining wrinkles are removed from the seat through the remaining wrinkle removing robot or the manual work.

Finally, the seat is finally inspected.

In the seat ironing system 8000 according to the present invention, a defective rate of the seat due to the generation of the wrinkles in the seat can be minimized.

Figure 7:
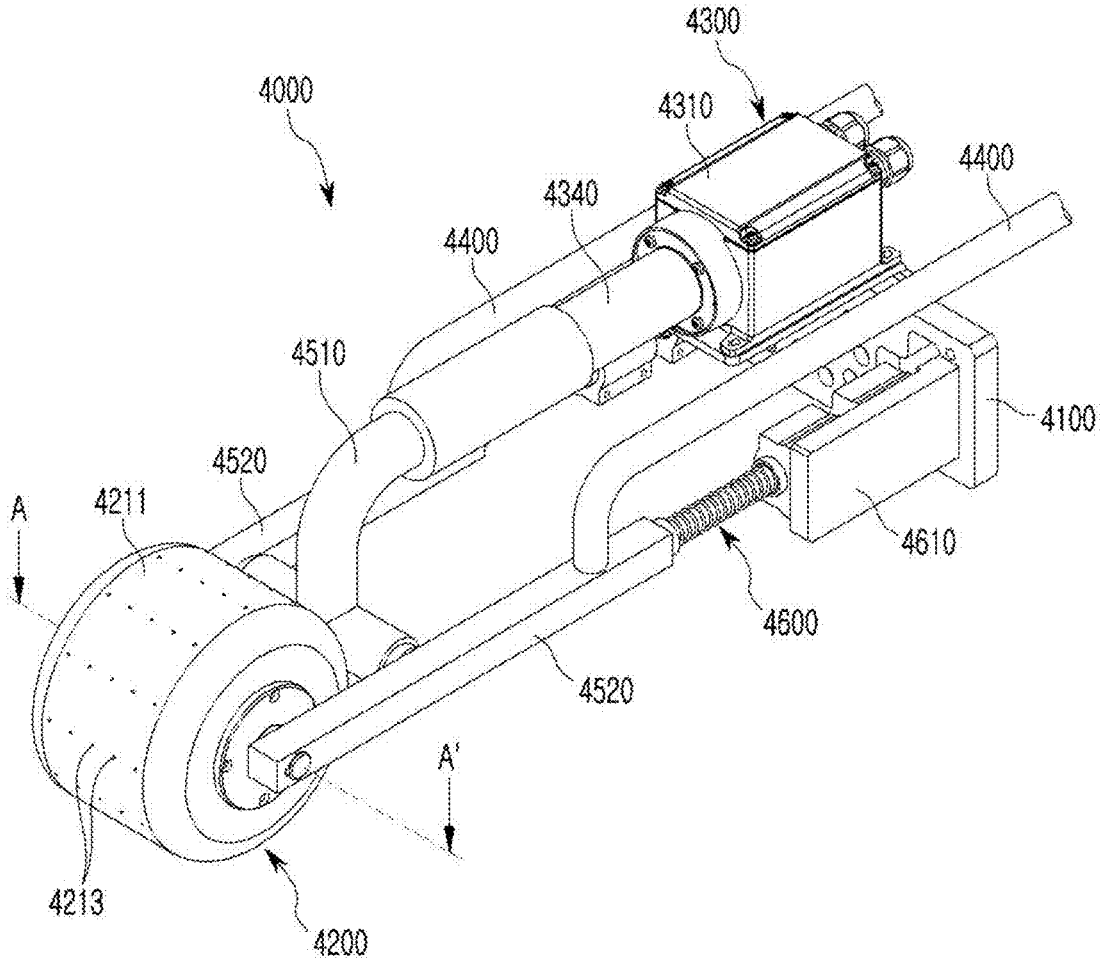
FIG. 7 is a top perspective view of a first steam ironing unit according to an embodiment of the present invention.
Figure 8:
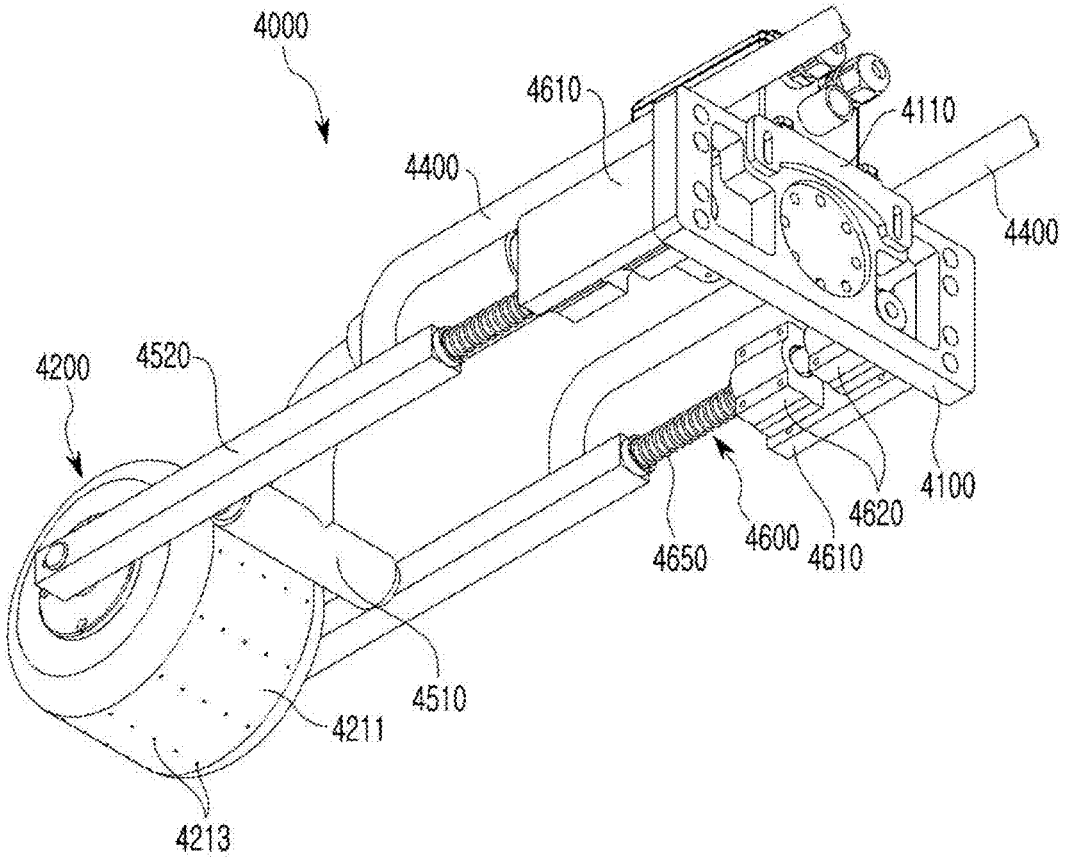
FIG. 8 is a bottom perspective view of the first steam ironing unit according to the embodiment of the present invention.
Figure 9:
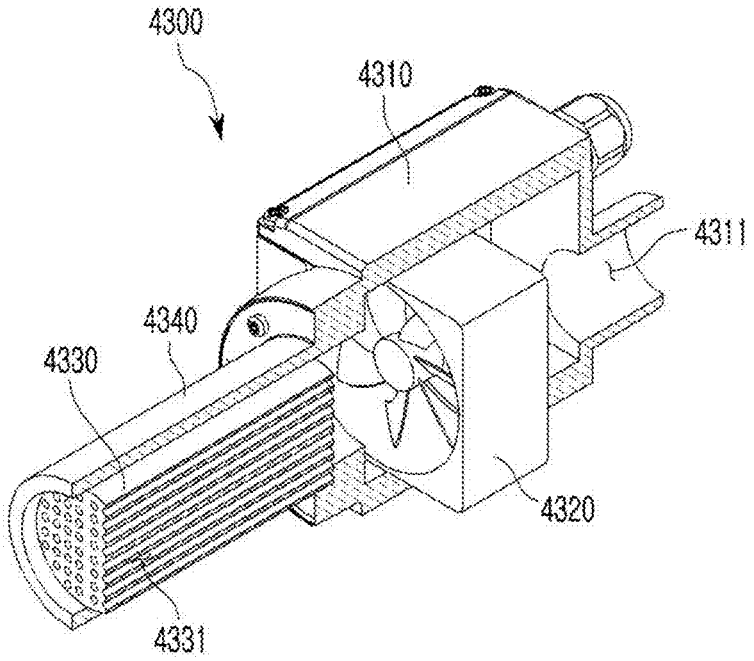
FIG. 9 is a cross-sectional view of a hot air supply unit according to an embodiment of the present invention.
Figure 10:
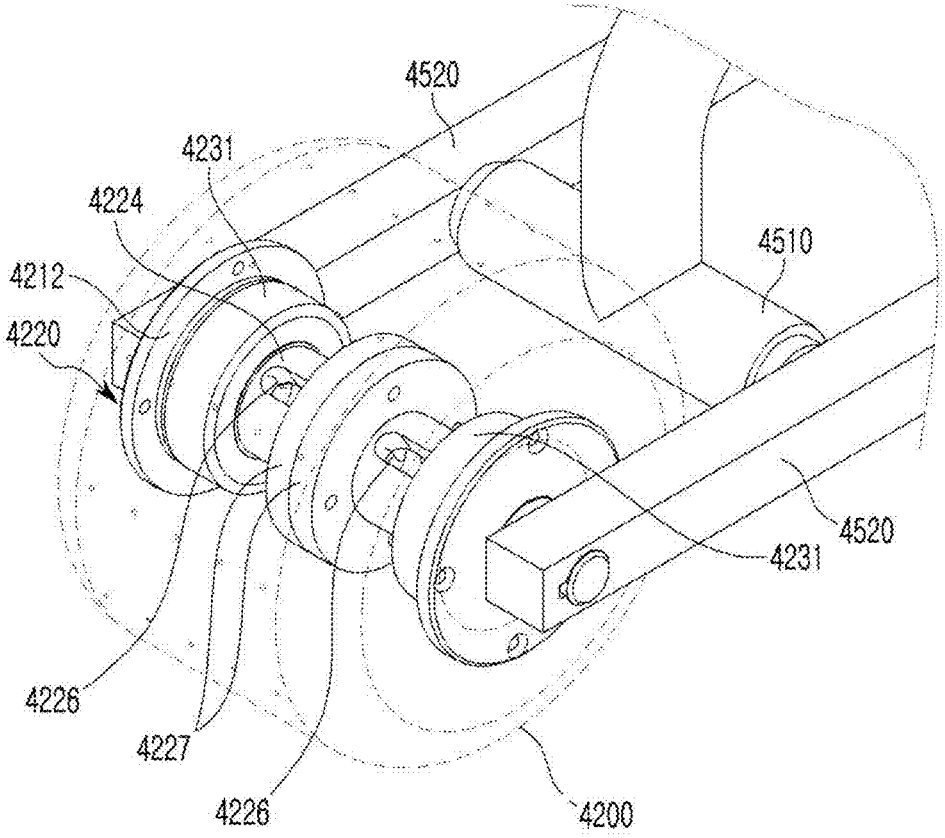
FIG. 10 is an exemplary view illustrating an interior of a seat pressing steam roller according to an embodiment of the present invention.
Figure 11:
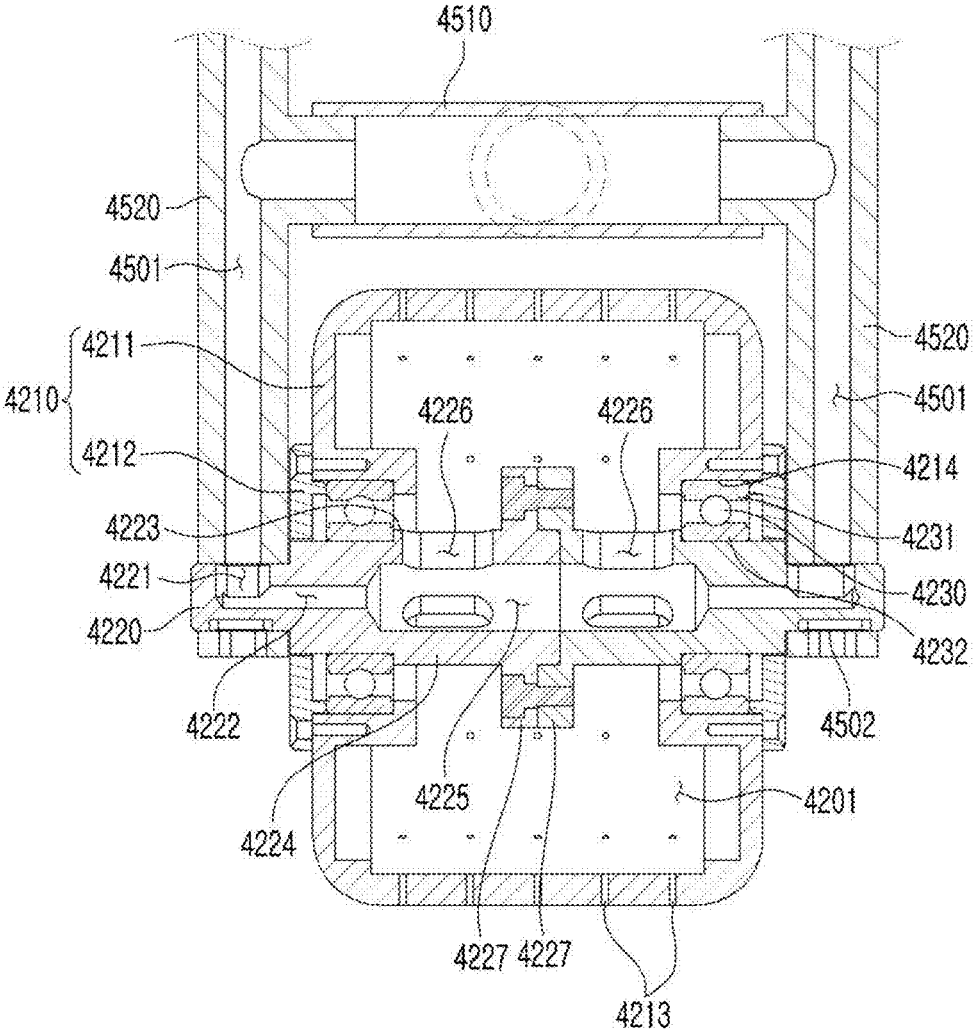
FIG. 11 is a cross-sectional view along line A-A' of FIG. 7.
Figure 12:
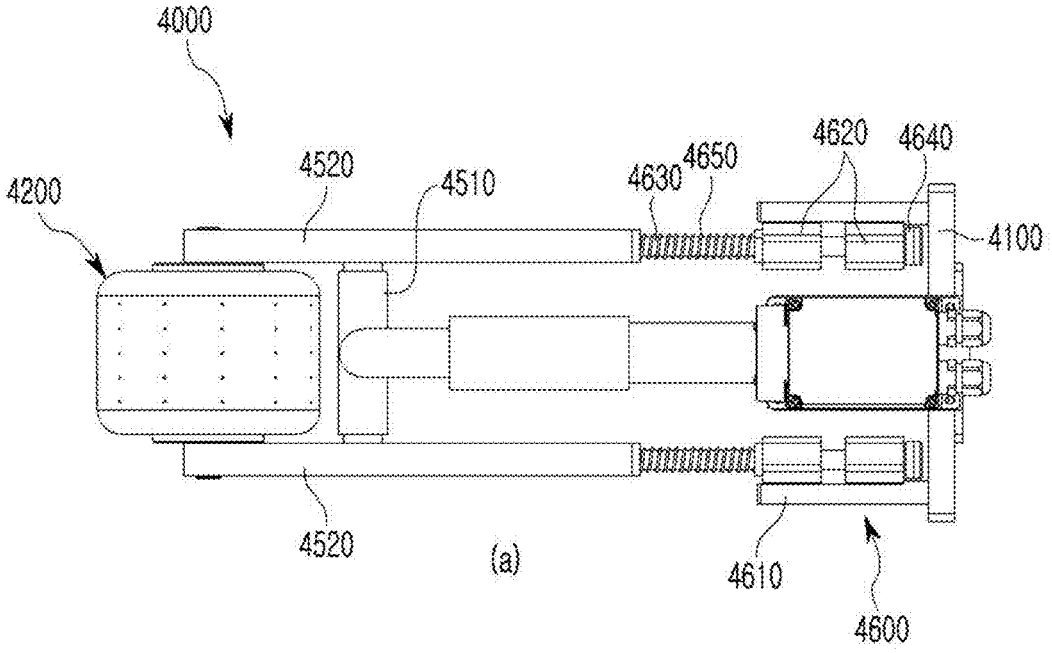
FIG. 12 is an exemplary view illustrating a pressed state of the seat pressing steam roller according to the embodiment of the present invention.
Figure 12:
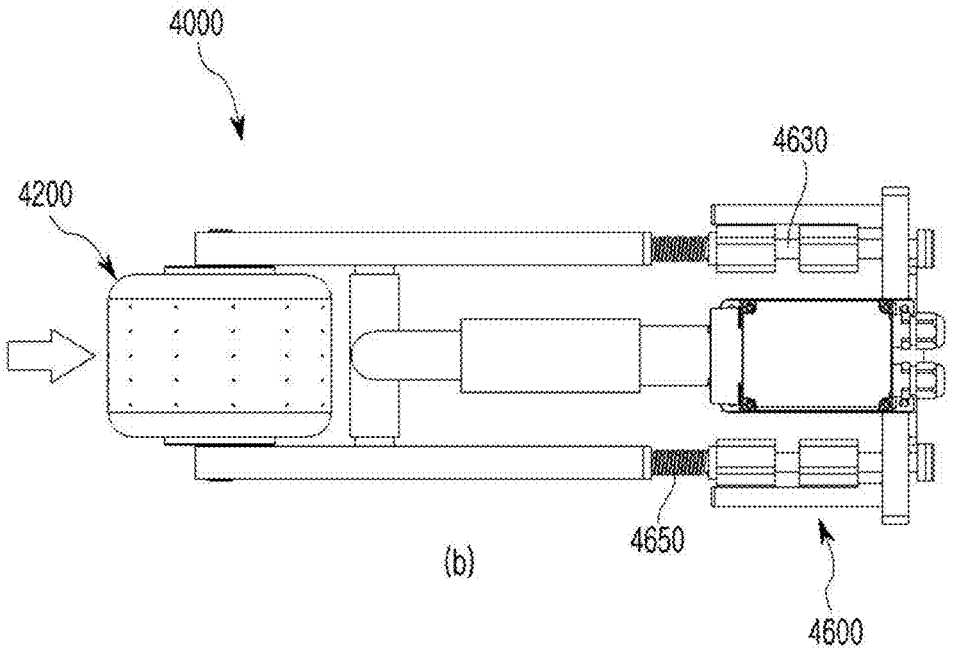
Figure 13:
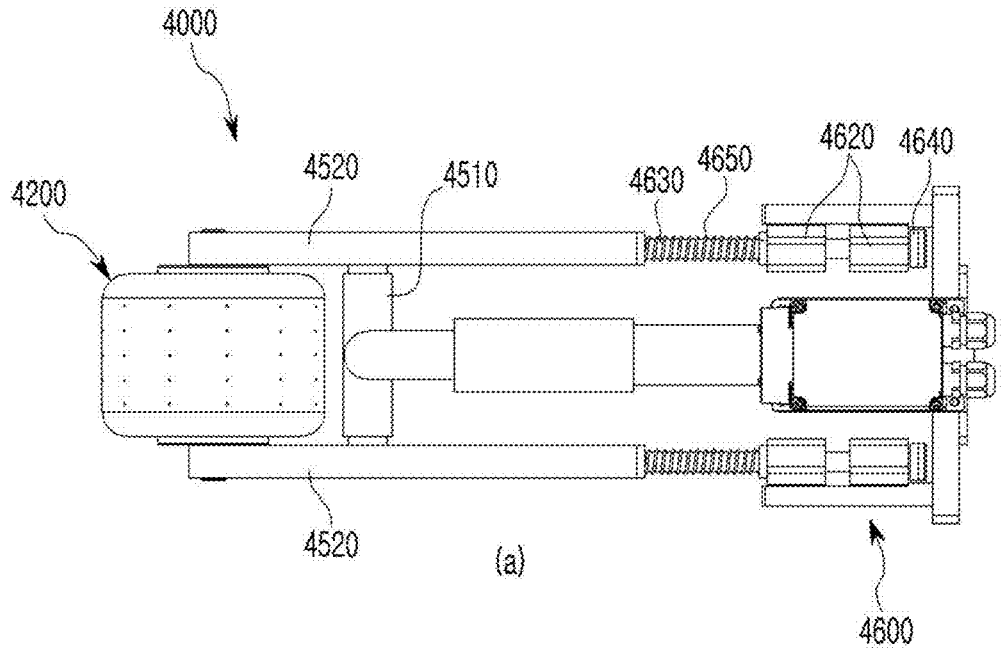
FIG. 13 is an exemplary view illustrating a tilted state of the seat pressing steam roller according to the embodiment of the present invention.
Figure 13:
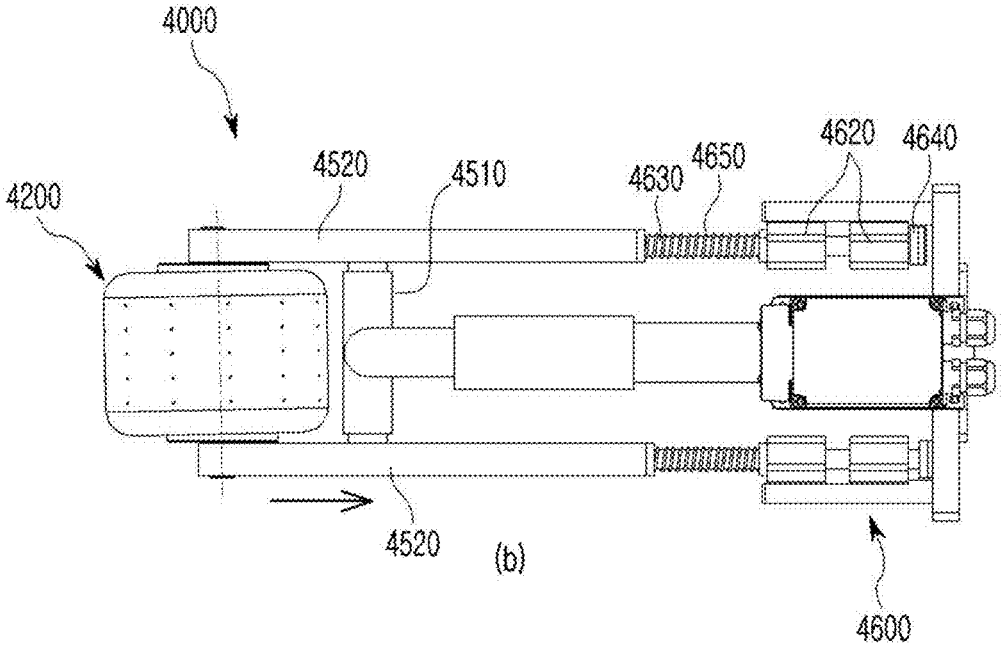
Figure 14:
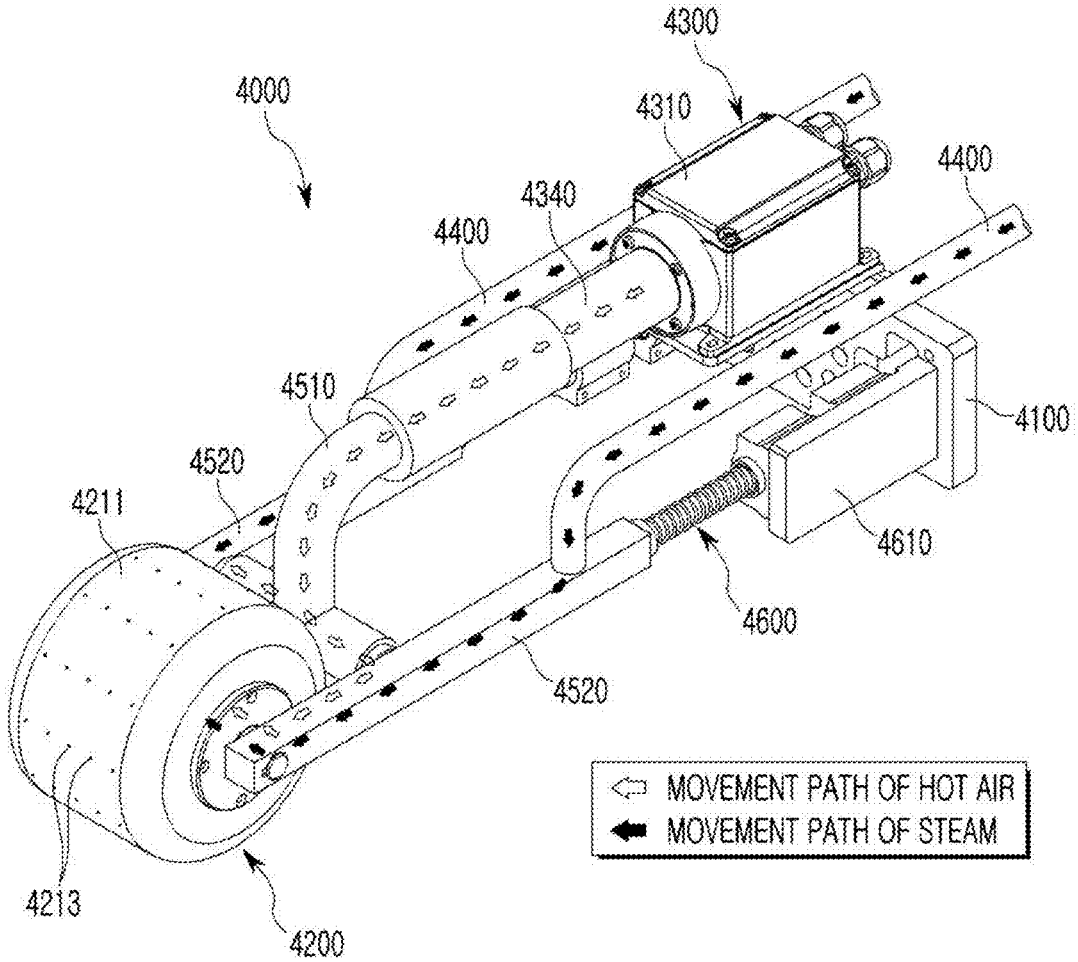
FIG. 14 is an exemplary diagram illustrating movement flows of steam and hot air according to the embodiment of the present invention.

FIG. 7 is a top perspective view of a first steam ironing unit according to an embodiment of the present invention, FIG. 8 is a bottom perspective view of the first steam ironing unit according to the embodiment of the present invention, FIG. 9 is a cross-sectional view of a hot air supply unit according to an embodiment of the present invention, FIG. 10 is an exemplary view illustrating an interior of a seat pressing steam roller according to an embodiment of the present invention, FIG. 11 is a cross-sectional view along line A-A' of FIG. 7, FIG. 12 is an exemplary view illustrating a pressed state of the seat pressing steam roller according to the embodiment of the present invention, FIG. 13 is an exemplary view illustrating a tilted state of the seat pressing steam roller according to the embodiment of the present invention, and FIG. 14 is an exemplary diagram illustrating movement flows of steam and hot air according to the embodiment of the present invention.

As illustrated in FIGS. 7 to 14, the first steam ironing unit 4000 is coupled to the first seat wrinkle removing robot 3100 to iron the seat.

Here, the first seat wrinkle removing robot 3100 is provided with a mounting plate 3101 on which the first steam ironing unit 4000 is mounted. The first seat wrinkle removing robot 3100 is provided with a multi-joint robot arm 3102, and thus the first steam ironing unit 4000 may be automatically moved to various required positions by operating the robot ram 3102.

The first steam ironing unit 4000 may include a fixing mount 4100, a seat pressing steam roller 4200, a hot air supply unit 4300, and a steam supply unit 4400.

Here, the fixing mount 4100 is coupled to the mounting plate 3101 of the first seat wrinkle removing robot 3100, and thus the first steam ironing unit 4000 may be fixedly supported on the first seat wrinkle removing robot 3100.

Further, the steam supply unit 4400 provides steam generated by a steam tank (not illustrated) to the seat pressing steam roller 4200.

The steam supply unit 4400 may have a hose pipe structure. One side of the steam supply unit 4400 is connected to the steam tank that generates the steam by heating water using a heat source such as electricity. Further, the other side of the steam supply unit 4400 supplies the steam generated by the steam tank to a fluid supply guide 4520. In this way, a configuration of moving the steam generated by the steam tank to the steam supply unit 4400 having a hose pipe structure is an already known configuration, and thus a detailed description thereof will be omitted.

Meanwhile, the hot air supply unit 4300 is fixedly supported on a fixing bracket 4110 provided on the fixing mount 4100.

The hot air supply unit 4300 supplies hot air into the seat pressing steam roller 4200. Accordingly, the steam supplied to the fluid supply guide 4520 through the steam supply unit 4400 may be converted into fine steam by the hot air supplied from the hot air supply unit 4300. The fine steam may be finally sprayed onto the seat through a spray hole 4213. That is, the hot air supply unit 4300 may prevent the steam supplied from the steam supply unit 4400 to the seat pressing steam roller 4200 from being phase-converted into water. Accordingly, the steam sprayed onto the seat through the spray hole 4213 may be sprayed in the form of fine steam. Thus, when the seat pressing steam roller 4200 presses and irons the seat, stains on the vehicle seat or damage to a seat surface can be prevented.

The hot air supply unit 4300 may include a casing 4310, a blower unit 4320, a heating unit 4330, and a discharge pipe 4340.

Here, an internal space is provided inside the casing 4310.

The blower unit 4320 may be disposed in the internal space. Here, the blower unit 4320 may be, for example, a fan.

Further, an external air inlet 4311 may be formed on one side of the casing 4310, and thus when the blower unit 4320 is operated, external air may flow into the casing 4310. In this way, the air flowing into the casing 4310 may be discharged through the discharge pipe 4340 coupled to the other side of the casing 4310. The air flowing-in through the external air inlet 4311 may be air from which dust, foreign substances, and the like are filtered.

Further, the discharge pipe 4340 is hollow and is coupled to the other side of the casing 4310. The discharge pipe 4340 communicates with the internal space of the casing 4310. Accordingly, the air discharged from the casing 4310 may be discharged to a hot air distributing unit 4510 through the discharge pipe 4340.

Further, the heating unit 4330 is provided inside the discharge pipe 4340. The heating unit 4330 may be, for example, a heating element that is heated by electricity or the like. The heating unit 4330 adjusts a temperature of the steam discharged through the seat pressing steam roller 4200 such that the steam having a predetermined temperature or higher is discharged. Here, a rotating roller unit 4210 that is in close contact with and pressed against the seat may be made of an aluminum material having high thermal conductivity. In this way, a temperature of the rotating roller unit 4210 in close contact with the seat does not need to be separately adjusted according to the type of leather seat.

A plurality of air movement holes 4331 are formed in the heating unit 4330 at predetermined intervals. Here, the air movement holes 4331 are formed in a longitudinal direction of the heating unit 4330 and pass through the heating unit 4330. The air movement holes 4331 discharges the air flowing into one side of the heating unit 4330 to the other side of the heating unit 4330 in a state in which the air is heated to a predetermined temperature.

In this way, the air heated by the heating unit 4330 is supplied to the hot air distributing unit 4510 coupled to the discharge pipe 4340.

Further, the hot air distributing unit 4510 distributes and supplies the heated air (hot air) supplied from the hot air supply unit 4300 to a pair of fluid supply guides 4520 formed at a predetermined interval. The hot air distributing unit 4510 communicates with the fluid supply guide 4520.

Meanwhile, the fluid supply guide 4520 supplies the steam supplied from the steam supply unit 4400 and the hot air supplied from the hot air supply unit 4300 into the seat pressing steam roller 4200.

The fluid supply guides 4520 may be formed at a predetermined interval and support the seat pressing steam roller 4200. The fluid supply guides 4520 support both ends of the seat pressing steam roller 4200.

A fluid movement passage 4501 is formed inside the fluid supply guide 4520. Accordingly, the steam and the hot air supplied from the steam supply unit 4400 and the hot air supply unit 4300 may be supplied to a fluid accommodating space 4201 through the fluid movement passage 4501. Here, it is preferable that the fluid supply guide 4520 and the hot air distributing unit 4510 be made of a material that is less affected by an external temperature. That is, it is preferable that the hot air distributing unit 4510 and the fluid supply guide 4520 be made of a material having low thermal conductivity. This is to prevent heat loss from being generated due to heat exchange between the outside and the steam and the hot air moved through the hot air distributing unit 4510 and the fluid supply guide 4520.

Meanwhile, the seat pressing steam roller 4200 may include the rotating roller unit 4210, a roller support pin 4220, and a bearing 4230.

Here, the rotating roller unit 4210 may have a roller pipe 4211 and a roller cover part 4212.

The roller pipe 4211 has a cylindrical shape and forms the overall exterior of the rotating roller unit 4210.

The fluid accommodating space 4201 in which the steam and the hot air supplied from the steam supply unit 4400 and the hot air supply unit 4300 are accommodated is formed inside the roller pipe 4211. In this way, the steam and the hot air guided to the fluid accommodating space 4201 may be sprayed to the outside through a plurality of spray holes 4213 formed in the roller pipe 4211.

An outer surface of the roller pipe 4211 is in close contact with and pressed against the seat, and the roller pipe 4211 may be made of an aluminum material having excellent thermal conductivity.

The plurality of spray holes 4213 formed in the roller pipe 4211 spray the fine steam guided to the fluid accommodating space 4201 onto the seat, and thus the wrinkle removing operation on the seat can be effectively performed.

Here, for example, the spray holes 4213 formed in the roller pipe 4211 may be arranged at predetermined intervals in a longitudinal direction of the roller pipe 4211. Further, the spray holes 4213 may be arranged at intervals of 15° to 30° along a circumference of the roller pipe 4211 with respect to an imaginary central axis of the roller pipe 4211. Here, when the spray holes 4213 are arranged at an interval of less than 15° along the circumference of the roller pipe 4211, the amount of fine steam discharged to the outside through the spray holes 4213 may be too large. Further, when the spray holes 4213 are arranged at an interval of more than 30° along the circumference of the roller pipe 4211, the fine steam is not effectively sprayed onto the seat. Thus, it is preferable that the spray holes 4213 be arranged at intervals of 15° to 30° along the circumference of the roller pipe 4211 with respect to an imaginary central axis of the roller pipe 4211.

Further, the roller cover part 4212 is coupled to both open sides of the roller pipe 4211. The roller cover part 4212 closes both open sides of the roller pipe 4211. Here, both outer circumferences of the roller pipe 4211 have a rounded shape. This is because, for example, when the outer circumferences of the roller pipe 4211 are formed in an angled shape, in a process of removing the wrinkles from the seat, scratches or the like may be generated on the seat due to the angled outer circumferences of the roller pipe. Accordingly, it is preferable that the outer circumferences of the roller pipe 4211 be formed in a rounded shape.

Further, the roller pipe 4211 is provided with a bearing support 4214 that supports the bearing 4230. In this way, in a state in which the bearing 4230 is supported on the bearing support 4214, the roller cover part 4212 fixedly supports the bearing 4230. Here, an outer ring 4231 of the bearing 4230 may be fixedly supported on the bearing support 4214.

Further, the roller support pin 4220 is fixedly inserted into a pin insertion hole 4502 formed in the fluid supply guide 4520. The roller support pin 4220 fixedly supports the rotating roller unit 4210 on the fluid supply guide 4520. The roller support pin 4220 supports an inner ring 4232 of the bearing 4230 while inserted into and coupled to the pin insertion hole 4502, and allows the rotating roller unit 4210 to be supported on the fluid supply guide 4520. The roller support pin 4220 may be provided with a bearing fixing member 4223 to prevent the bearing 4230 from shaking.

A first communication hole 4221 that communicates with the fluid movement passage 4501 and a second communication hole 4222 that communicates with the fluid accommodating space 4201 are formed inside the roller support pin 4220. Here, the first communication hole 4221 and the second communication hole 4222 communicate with each other. Accordingly, the fine steam (the stem and the hot air) moved through the fluid movement passage 4501 may be moved to a third communication hole 4225 through the first communication hole 4221 and the second communication hole 4222.

The roller support pin 4220 may be provided with an expansion pipe part 4224. The expansion pipe part 4224 may be provided at an end portion of the roller support pin 4220, and a flange part 4227 may be provided at an end portion of the expansion pipe part 4224. Accordingly, a pair of roller support pins 4220 facing each other may be coupled to each other by the flange part 4227.

The third communication hole 4225 that communicates with the second communication hole 4222 is formed in the expansion pipe part 4224. Accordingly, the fine steam moved to the third communication hole 4225 through the second communication hole 4222 may be discharged into the fluid accommodating space 4201 through a plurality of discharge holes 4226 formed in the expansion pipe part 4224. The plurality of discharge holes 4226 may be formed at predetermined intervals along a circumference of the expansion pipe part 4224.

The expansion pipe part 4224 discharges the fine steam discharged through the second communication hole 4222 while the fine steam is guided to an inner central side of the rotating roller unit 4210. Accordingly, the fine steam can be effectively discharged to the outside through the spray holes 4213.

A size of the third communication hole 4225 that communicates with the second communication hole 4222 is larger than a size of the second communication hole 4222. Accordingly, the fine steam discharged into the fluid accommodating space 4201 can be effectively diffused. Thus, the fine steam may be uniformly supplied to any location in the fluid accommodating space 4201.

The bearing 4230 is supported on the bearing support 4214 and the roller support pin 4220. Accordingly, in a process of moving the rotating roller unit 4210 while the rotating roller unit 4210 is in close contact with and pressed against the seat by the first seat wrinkle removing robot 3100, the rotating roller unit 4210 may be rolled (rotated) about the roller support pin 4220.

In the seat pressing steam roller 4200, when the rotating roller unit 4210 having a cylindrical shape is in close contact with and pressed against the seat, the rotating roller unit 4210 may be in line close contact with and pressed against the seat. In other words, in the case of a steam ironing unit having a flat ironing surface according to the related art, the seat and the ironing surface are in surface contact with each other, and thus the seat having various shapes (a curved surface, a bent area, or the like) cannot be effectively ironed. However, since the rotating roller unit 4210 according to the present invention is in line close contact with and pressed against the seat, even when the seat has various shapes, the wrinkles can be effectively removed from the seat.

Meanwhile, a movement adjusting unit 4600 enables one or more of adjusting a pressing force and tilting of the seat pressing steam roller 4200 in a process in which the seat pressing steam roller 4200 is in close contact with and pressed against the seat.

The movement adjusting unit 4600 may include a support frame 4610, a shaft support 4620, a shaft 4630, a stopper 4640, and an elastic spring 4650.

Here, a pair of support frames 4610 are provided to face each other. The support frames 4610 are coupled to one side and the other side of the fixing mount 4100.

The shaft support 4620 is coupled to an interior of the support frame 4610. The shaft support 4620 supports the shaft 4630 coupled to an end portion of the fluid supply guide 4520, and at the same time, guides a movement direction of the shaft 4630.

Further, the shaft 4630 is inserted to pass through the shaft support 4620. The shaft 4630 guides the movement of the seat pressing steam roller 4200 in a front-rear direction in a process of moving the seat pressing steam roller 4200 while pressing the seat.

The stopper 4640 is coupled to an end portion of the shaft 4630 to prevent the shaft 4630 from being separated from the shaft support 4620.

Further, the elastic spring 4650 is inserted to pass through the shaft 4630. One end of the elastic spring 4650 is supported on the shaft support 4620, and the other end thereof is supported on the fluid supply guide 4520.

When the seat pressing steam roller 4200 is pressed with a predetermined force or more, the elastic spring 4650 is compressed. That is, when a force greater than an elastic force of the elastic spring 4650 is applied to the seat pressing steam roller 4200 in a process in which the seat pressing steam roller 4200 is in close contact with and pressed against the seat, the elastic spring 4650 is compressed. In this case, the seat pressing steam roller 4200 is in close contact with and pressed against the seat with a predetermined force by the compressed elastic spring 4650.

Further, when a force less than a predetermined force is applied to the seat pressing steam roller 4200, the compressed elastic spring 4650 may be restored.

In this way, as the movement adjusting unit 4600 is provided with the elastic spring 4650, the seat pressing steam roller 4200 may be in close contact with and pressed against the seat with a certain force. Thus, a seat wrinkle removing operation may be performed for all the seat surfaces under the same conditions.

As illustrated in FIG. 12, when the seat pressing steam roller 4200 presses the seat, the same pressing force may be applied to a pair of spaced elastic springs 4650 and thus the elastic springs 4650 may be equally pressed, and as illustrated in FIG. 13, different pressing forces are applied to the elastic springs 4650, and thus the seat pressing steam roller 4200 may be tilted.

In this way, the movement adjusting unit 4600 adjusts the pressing force of the seat pressing steam roller 4200 and tilts the seat pressing steam roller 4200 in a customized manner for various seat shape such as curved portions and flat portions of the seat surface. Accordingly, the wrinkle removing operation on the seat can be effectively performed.

However, this is merely embodiments of the present invention, and the scope of rights of the present invention is not limited by the scope of the descriptions of the embodiments.

The above description of the present invention is merely illustrative, and those skilled in the art to which the present invention pertains can understand that the present invention can be easily modified in other specific forms without changing the technical spirit or essential features of the present invention. Therefore, it should be understood that the embodiments described above are illustrative but not limiting in all aspects. For example, components described as a single type may be implemented in a distributed manner, and likewise, components described as a distributed manner may also be implemented in a coupled form.

The scope of the present invention is indicated by the appended claims, and all changes or modifications derived from the meaning and scope of the appended claims and equivalent concepts thereof should be construed as being included in the scope of the present invention.

The invention claimed is:

1. A seat ironing system comprising:

a first vision unit configured to photograph a seat;

a seat preheating unit configured to preheat the seat passing through the first vision unit to a predetermined temperature;

an ironing robot unit provided with a steam ironing unit configured to remove wrinkles from the seat passing through the seat preheating unit; and a seat heat treatment unit configured to heat-treat the seat from which the wrinkles are removed through the ironing robot unit, wherein the ironing robot unit removes the wrinkles from the seat based on seat image information provided from the first vision unit, wherein the ironing robot unit has a first seat wrinkle removing robot and a second seat wrinkle removing robot configured to perform a wrinkle removing operation on the seat according to a material of the seat, and the first seat wrinkle removing robot performs a wrinkle removing operation on a leather seat, and the second seat wrinkle removing robot performs a wrinkle removing operation on a fabric seat, wherein the first seat wrinkle removing robot is provided with a first steam ironing unit configured to remove the wrinkles from the seat, the first steam ironing unit includes:

a fixing mount coupled to a mounting plate of the first seat wrinkle removing robot;

a seat pressing steam roller having a fluid accommodating space formed therein and configured to iron the seat while being rotated in close contact with the seat by operating the first seat wrinkle removing robot;

a hot air supply unit fixedly supported on the fixing mount and configured to supply hot air into the seat pressing steam roller; and a pair of steam supply units configured to supply steam generated from a steam tank into the seat pressing steam roller, and a plurality of spray holes are formed in the seat pressing steam roller at predetermined intervals.

2. The seat ironing system of claim 1, wherein the seat preheating unit includes:

a heating booth in which a preheating space in which the seat is accommodated is formed; and a heating unit configured to preheat the seat moved to the preheating space, and the heating unit is operated when a material of the seat moved to the preheating space is a predetermined material.

3. The seat ironing system of claim 2, wherein the heating unit includes:

a first heater installed in the heating booth and configured to preheat a cushion seat provided in the seat; and a second heater installed in the heating booth and configured to preheat a back seat provided in the seat, and the first heater and the second heater are infrared heaters.

4. The seat ironing system of claim 1, wherein the steam supply unit supplies the steam to fluid supply guides configured to support both ends of the seat pressing steam roller and spaced a predetermined interval from each other, the hot air supply unit is coupled to a hot air distributing unit communicating with the fluid supply guides, and the hot air discharged from the hot air supply unit is distributed and supplied to the spaced fluid supply guides through the hot air distributing unit, and the steam and the hot air discharged from the steam supply unit and the hot air supply unit to the fluid supply guides are supplied to the fluid accommodating space.

5. The seat ironing system of claim 4, further comprising a movement adjusting unit supported on the fixing mount, wherein the movement adjusting unit includes:

a pair of support frames coupled to one side and the other side of the fixing mount to face each other;

a shaft support coupled to an interior of the support frame;

a shaft coupled to an end portion of the fluid supply guide and inserted to pass through the shaft support;

a stopper coupled to an end portion of the shaft; and an elastic spring which is inserted to pass through the shaft and of which one end is supported on the shaft support and the other end is supported on the fluid supply guide, and the seat pressing steam roller enables one or more of adjusting a pressing force and tilting by the movement adjusting unit in a process in which the seat pressing steam roller is in close contact with and pressed against the seat.

6. The seat ironing system of claim 4, wherein the seat pressing steam roller includes:

a rotating roller unit having a roller pipe, which has a cylindrical shape and the fluid accommodating space therein, and a roller cover part configured to close both open sides of the roller pipe;

a roller support pin inserted to pass through a pin insertion hole formed in the fluid supply guide and configured to support the rotating roller unit on the fluid supply guide; and a bearing of which an outer ring is supported on a bearing support provided in the roller pipe and an inner ring is supported on the roller support pin, and a first communication hole communicating with a fluid movement passage formed inside the fluid supply guide and a second communication hole communicating with the first communication hole are formed in the roller support pin, and the rotating roller unit is rotated while supported on the roller support pin.

7. The seat ironing system of claim 6, wherein the roller support pin is provided as a pair of roller support pins provided with an expansion pipe part having a third communication hole communicating with the second communication hole, a flange part provided in the expansion pipe part connects the pair of roller support pins facing each other, a plurality of discharge holes that discharge the steam and the hot air to the fluid accommodating space are formed in the expansion pipe part, and the third communication hole is formed to have a larger hole size than the second communication hole.

8. The seat ironing system of claim 6, wherein the spray holes formed in the roller pipe are formed at predetermined intervals in a longitudinal direction of the roller pipe and arranged at intervals of 15° to 30° along a circumference of the roller pipe with respect to an imaginary central axis.

9. The seat ironing system of claim 1, further comprising a second vision unit configured to identify remaining wrinkles in the seat passing through the seat heat treatment unit.

10. The seat ironing system of claim 9, wherein the first vision unit is provided with a first camera unit configured to photograph the seat from which the wrinkles are removed, and the first camera unit includes a first photographing unit configured to photograph a portion of a cushion seat of the seat and a second photographing unit configured to photograph a portion of a back seat of the seat, and the second vision unit includes a second camera unit configured to photograph remaining wrinkles in the seat and a processor configured to receive remaining wrinkle image information of the seat photographed by the second camera unit, and the second camera unit includes a third photographing unit configured to photograph the portion of the cushion seat of the seat and a fourth photographing unit configured to photograph the portion of the back seat of the seat.

11. The seat ironing system of claim 10, wherein the processor calculates the number, locations, and sizes of the remaining wrinkles in the seat based on the remaining wrinkle image information, and the number, the locations, and the sizes of the remaining wrinkles in the seat, which are calculated by the processor, are displayed on a monitor unit.

12. A method of operating a seat ironing system, comprising:

photographing, by a first vision unit, a state of a wrinkle of a seat;

preheating, by a seat preheating unit, the seat passing through the first vision unit;

removing, by an ironing robot unit, the wrinkle of the seat passing through the seat preheating unit;

heat treating, by a seat heat treatment unit, the seat passing through the ironing robot unit; and photographing, by a second vision unit, remaining wrinkles of the seat passing through the seat heat treatment unit, wherein a processor provided in the second vision unit determines whether the remaining wrinkles are present in the seat by calculating the number, locations, and sizes of the remaining wrinkles in the seat based on remaining wrinkle image information provided from a second camera unit provided in the second vision unit.

13. The method of claim 12, wherein, when the processor determines that the remaining wrinkles are present in the seat, the remaining wrinkles are removed from the seat through a remaining wrinkle removing robot or manual work.

* * * * *